United States Patent [19]

Alperine et al.

[11] Patent Number: 4,962,005

[45] Date of Patent: Oct. 9, 1990

[54] METHOD OF PROTECTING THE SURFACES OF METAL PARTS AGAINST CORROSION AT HIGH TEMPERATURE, AND A PART TREATED BY THE METHOD

[75] Inventors: Serge Alperine, Paris; Pierre Josso, Issy les Moulineaux, both of France

[73] Assignee: Office National D'Etudes et de Recherches Aerospatiales, Chatillon Sous Bagneux, France

[21] Appl. No.: 419,974

[22] Filed: Oct. 11, 1989

[30] Foreign Application Priority Data

Oct. 26, 1988 [FR] France ..... 88 13991

[51] Int. Cl.[5] ..... B32B 15/04; C23C 10/52; C23C 10/56

[52] U.S. Cl. ..... 428/670; 428/678; 427/252; 427/383.9; 427/405

[58] Field of Search ..... 428/666, 667, 670, 678, 428/679, 680, 681, 941, 610; 427/252, 253, 405, 383.9; 204/192.15, 192.16, 47

[56] References Cited

U.S. PATENT DOCUMENTS

| | | | |
|---|---|---|---|
| 3,677,789 | 7/1972 | Bunghardt et al. | 428/670 |
| 3,692,554 | 9/1972 | Bunghardt et al. | 428/941 |
| 3,819,338 | 6/1974 | Bunghardt et al. | 428/941 |
| 3,898,052 | 8/1975 | Dean et al. | 428/673 |
| 3,961,910 | 6/1976 | Baladjanian et al. | 428/941 |
| 3,979,273 | 9/1976 | Panzera et al. | 427/405 |
| 4,145,481 | 3/1974 | Gupta et al. | 428/680 |
| 4,313,760 | 2/1982 | Dardi et al. | 428/678 |
| 4,346,137 | 8/1982 | Hecht | 428/678 |
| 4,399,199 | 8/1983 | McGill et al. | 428/678 |
| 4,439,470 | 3/1984 | Sievers | 428/615 |
| 4,477,538 | 10/1984 | Clarke | 428/670 |
| 4,501,776 | 2/1985 | Shankar | 427/253 |
| 4,526,814 | 7/1985 | Shankar | 427/383.9 |
| 4,530,885 | 7/1985 | Restall | 428/670 |

FOREIGN PATENT DOCUMENTS

| | | | |
|---|---|---|---|
| 183852 | 6/1986 | European Pat. Off. . | |
| 186266 | 7/1986 | European Pat. Off. | 427/383.9 |
| 2072284 | 9/1971 | France . | |
| 55-18573 | 2/1920 | Japan | 427/383.9 |

OTHER PUBLICATIONS

McMinn et al., Transactions of the ASME—Journal of Engineering for Gas Turbines and Power, vol. 110, pp. 142–149, Jan. 1988.

*Primary Examiner*—John F. Zimmerman
*Attorney, Agent, or Firm*—Armstrong, Nikaido, Marmelstein, Kubovcik & Murray

[57] ABSTRACT

A method including aluminization treatment preceded by a palladium predeposition treatment, the palladium being associated with at least one barrier metal selected from nickel, cobalt, and chromium, thereby avoiding hydrogen occlusion.

29 Claims, 3 Drawing Sheets

METHOD OF PROTECTING THE SURFACES OF METAL PARTS AGAINST CORROSION AT HIGH TEMPERATURE, AND A PART TREATED BY THE METHOD

The invention relates to protecting metal materials against corrosion at high temperature, and more particularly materials based on nickel, cobalt, and/or iron, including steels.

BACKGROUND OF THE INVENTION

The invention relates more particularly to superalloys, in particular those based on nickel and used for making the hot parts of turbomachines, for example the fixed or moving turbine blades of gas turbines which must have excellent resistance to corrosion and oxidization at high temperature, particularly in the presence of molten sodium sulfate from spray and sulfur-containing impurities in the fuel.

One known protection method for this purpose consists in diffusing and/or depositing a layer containing nickel, cobalt, and/or iron aluminide on the surface of the substrate to be protected by using a treatment which includes putting the part to be treated into contact with an additional substance containing aluminium.

One such deposition treatment known as "low activity aluminization" or as "chrome-aluminization" is described in detail in French patent number FR-A-1 490 744, the content of which is incorporated into the present description by reference. In this prior treatment, the additional substance comprises a chromium-based alloy containing 5% to 25% by weight of aluminum and possibly containing 3% to 10% by weight of silicon, with the parts to be treated being put into contact with the additional substance in a finely divided state under a hydrogen-containing atmosphere at a temperature lying between 750° C. and 1200° C.

In order to improve the effectiveness of the aluminization treatment, proposals have been made to precede the aluminization treatment with a predeposition treatment comprising depositing and/or diffusing at least one platinum group metal on the surface of the substrate, with the aluminization treatment then being either low activity aluminization as mentioned above, or else a variant thereof referred to as "high activity aluminization", or else some other type of treatment, e.g. vapor phase aluminization as designated under the reference RT22 by Chromalloy. High activity aluminization differs from low activity aluminization described above in that the metal fraction of the additional substance comprises 55% to 70% aluminum and 45% to 30% chromium, by weight, in that the treatment temperature lies in the range 650° C. to 750° C., and is preferably equal to about 700° C, and in that its duration lies in the range 7 hours to 8 hours and is preferably equal to about 7½ hours. Such high activity deposition is followed by post diffusion treatment under a non-oxidizing atmosphere (argon or hydrogen) for a period of time and at a temperature which depend on the substrate.

Such a method is described, for example, in the following patents: FR-A-2 071 753, FR-A-2 333 055, GB-A-2 129 017, US-A-3 677 789, US-A-3 819 338, US-A-4 43-9 470, and US-A-3 692 554.

The most commonly used platinum group metal for predeposition treatment is platinum itself which provides a clear improvement in the protection provided by the aluminization treatment. However platinum suffers from the drawback of being very expensive.

Other platinum group metals are mentioned in the above-referenced prior documents, including palladium which is about four times cheaper than platinum. The Applicant has therefore attempted to use palladium instead of platinum, but great difficulties were encountered. It was observed that nickel-based superalloy samples subjected to a predeposition treatment using pure palladium followed by low or high activity aluminization treatment suffered from numerous blisters, leading to poor resistance to corrosion when hot and fragilizing the coating. The Applicant has determined that these blisters are due to a large quantity of occluded hydrogen in the palladium layer which is dissolved in the predeposit while the coating is being made, since hydrogen is very highly soluble in palladium.

The object of the invention is to obtain an aluminide coating modified by a predeposit containing a platinum group metal other than platinum itself, and in particular containing palladium, while avoiding the occlusion of hydrogen or any other gas that could give rise to the phenomenon of blistering.

SUMMARY OF THE INVENTION

The present invention provides a part comprising a metal substrate based on nickel, cobalt, and/or iron, and a protective coating constituted by a deposit and a predeposit between the substrate and the deposit, the predeposit containing at least one platinum group metal other than platinum itself and comprising one or more layers, and the deposit containing an aluminide of nickel and/or cobalt and/or iron modified by said platinum group metal, wherein the predeposit also contains at least one barrier metal selected from nickel, cobalt, and chromium, the barrier metal being present in any layer containing said platinum mine metal and/or in at least one overlying layer.

Nickel, cobalt, and chromium have the property of dissolving practically no gas even at high temperature, thereby protecting platinum group metals, and in particular palladium, against such dissolution.

The thickness of the predeposit preferably does not exceed about 100 μm, and may be about 10 μm.

In one implementation of the invention, at least one layer of predeposit is essentially constituted by an alloy of at least one platinum group metal with at least one barrier metal. The predeposit may then comprise one layer only.

In another implementation, a first layer of predeposit is formed essentially from at least one platinum group metal, and a second layer overlying the first is formed essentially from at least one barrier metal. The terms "first layer" and "second layer" do not refer herein to the absolute position of the layers within the predeposit, but serve simply to identify the two layers under consideration relative to each other. In this case, the first and second layers may be adjacent and they may constitute the only two layers in the predeposit.

The invention also provides a method of protecting the surface of a metal substrate based on nickel, cobalt, and/or iron, the method comprising predeposition treatment followed by deposition treatment, the deposition treatment comprising depositing and/or diffusing aluminum at the surface of the pretreated substrate, and the predeposition treatment comprising one or more successive stages during which a substance is added by being deposited and/or caused to diffuse at the surface of the substrate, the composition of the added substance optionally being different from one stage to another and said added substance containing, at least during one stage, at least one platinum group metal other than platinum itself, wherein during any stage for which said added substance contains said platinum group metal and/or during at least one subsequent pretreatment stage, said added substance includes at least one barrier metal selected from nickel, cobalt, and chromium.

During the deposition treatment, the pretreated substrate may be put into contact with a carrier substance containing aluminum and chromium. Such deposition treatment may be low or high activity aluminization as defined above, for example.

At least one predeposition treatment stage may comprise an operation of depositing an additional substance at low temperature followed by a diffusion operation at high temperature and under a vacuum. Said diffusion operation is preferably performed at a temperature of about 850° C under a pressure of air not greater than $10^{-5}$ torr.

In an implementation of the invention, at least one predeposition treatment stage comprises depositing and/or diffusing an alloy of at least one platinum group metal and at least one barrier metal. The predeposition treatment may then comprise a single stage during which substance is added.

In a second implementation, the added substance in the first predeposition treatment stage is essentially constituted by at least one platinum group metal, and in a second stage, subsequent to the first, the added substance is constituted essentially by at least one barrier metal. The terms "first stage" and "second stage" call for the same comments as made above about the terms "first layer" and "second layer". The first and second stages may follow one another directly and, for example, they may constitute the only two stages during which substance is added during the predeposition treatment.

The invention is more particularly applicable to a substrate based on nickel, with the aluminide being essentially nickel aluminide and with the barrier metal being likewise, preferably, essentially nickel.

The platinum group metal is preferably essentially palladium.

When depositing an alloy of palladium and nickel, the alloy advantageously comprises about 80% palladium and 20% nickel by weight and is, for example, deposited electrolytically.

When palladium and nick=1 are deposited in succession, palladium may be deposited by a self-catalyzing chemical technique while nickel is deposited by triode cathode sputtering.

BRIEF DESCRIPTION OF THE DRAWINGS

Embodiments of the invention are described by way of example with reference to the accompanying drawings, in which.

DETAILED DESCRIPTION

Figure 1:
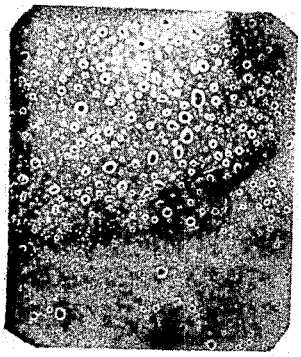
FIG. 1 PRIOR ART
FIGS. 1 and 2 are photographs showing a sample treated using the prior art, respectively before and after a high temperature corrosion test.
Figure 2:
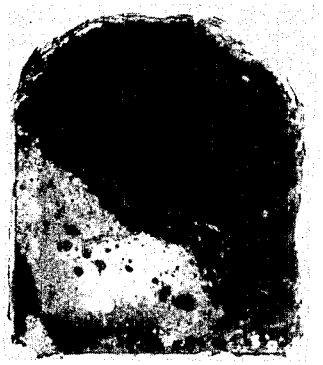
FIG. 2 PRIOR ART
Figure 3:
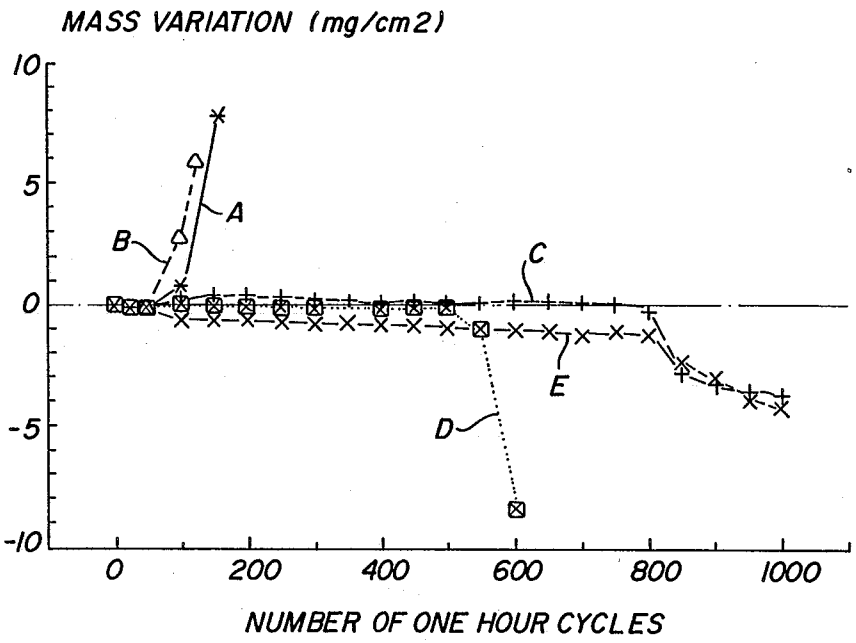
FIG. 3 is a graph showing change in mass per unit area of various treated samples subjected to corrosion tests.

In order to illustrate the difficulties that stem from using palladium in the prior art method of depositing aluminide as modified by a predeposition stage, an 8 μm thick predeposit of pure palladium was formed on a substrate made of IN100 superalloy, with predeposition being performed by triode cathode sputtering. The sample was then subjected to two hours of heat treatment at 850° C in order to diffuse the predeposit, with the treatment being performed under a total air pressure of not more than $10^{-5}$ torr. A high activity type of nickel aluminide, as defined above, was then coated onto said sample by pack activated cementation. After the final post diffusion operation, the surface of the sample was covered by a very large number of blisters (FIG. 1). Such a coating surface state makes the material unusable for turbomachine components. The sample was then subjected to high temperature corrosion testing by thermocycling in an oven open to the air and between temperatures of about 200° C. and 850° C., with one hour pauses at 850° C., periodically contaminating the sample with 0.5 mg/cm$^2$ of sodium sulfate every 50 cycles. This test is representative of the constraints to which components in the hot portions of turbomachines are subjected under hot corrosion conditions. The resistance of the coating to corrosion while hot was very low. After 150 one hour cycles the state of degradation of the sample became critical (FIG. 2) and major corrosion in the form of corrosion pits can be observed. The increase in mass was very high (FIG. 3, curve A). The behavior of this sample was comparable to the behavior of a sample subjected to conventional high activity aluminization in the absence of any predeposit, as can be seen in FIG. 3 where curve B relates to such a sample.

Entirely similar results were obtained when the high activity aluminization treatment was replaced by low activity type pack aluminization and/or when the palladium predeposit was obtained by a self-catalyzing chemical procedure.

Examples of the invention are described below.

EXAMPLE 1

Figure 4:
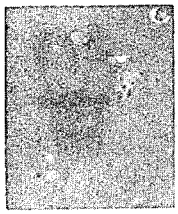
FIGS. 4, 6, 8, and 9 are photographs showing samples treated in accordance with the invention.
Figure 5:
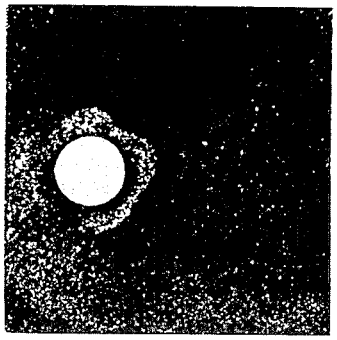
FIGS. 5 and 7 are photographs showing the samples of FIGS. 4 and 6 respectively, after corrosion testing.

About 10 μm of palladium-nickel alloy having 20% nickel by weight was electrolytically deposited on an IN100 nickel based superalloy substrate. The sample was then subjected to two hours of diffusion heat treatment at 850° C. under a total air pressure of not more than $10^{-5}$ torr. A standard high activity type nickel aluminide coating was then made on this sample by pack activated cementation. After a final post diffusion operation, the surface of the sample was free from any blisters (FIG. 4). The sample was subjected to the hot corrosion test described above for samples treated using the prior technique. Excellent results were obtained. The curve showing change in weight is given in FIG. 3 (curve C). In addition, after 1000 one-hour cycles, no pitting corrosion and no internal corrosion of the part were observed (FIG. 5). By way of comparison, FIG. 3 also shows (curve D) the change in weight of a sample of identical shape constituted by a substrate of the same nature covered with an RT22 type platinum-modified aluminide coating. Pitting corrosion was observed along the edges of this sample after about 600 cycles.

EXAMPLE 2

Figure 6:
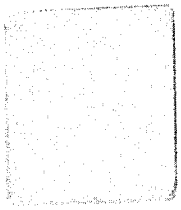
Figure 7:
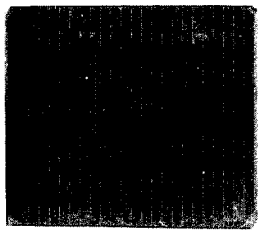

The procedure was the same as in Example 1 except that high activity aluminization was replaced using standard low activity type aluminization. The same result was obtained (see FIG. 3, curve E), and FIGS. 6 and 7 show the sample respectively before and after corrosion testing.

EXAMPLE 3

Figure 8:
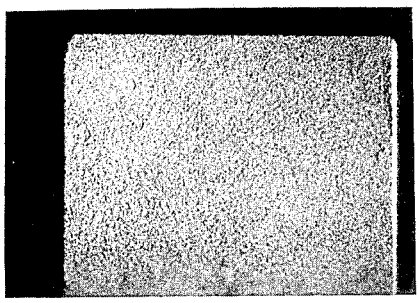

This example differs from Example 1 solely in the predeposition treatment. In this case the predeposition treatment comprises two stages during which substance is added. In the first stage, about 8 μm of pure palladium were added by a self-catalytic chemical process. The sample was then subjected to two hours of diffusion heat treatment at 850° C under a total air pressure of not more than $10^{-5}$ torr. During the second stage, about 3 μm of pure nickel was deposited by triode cathode sputtering. The sample was then subjected to a second diffusion heat treatment identical to the first. FIG. 8 shows that the resulting sample is free from any blistering and has an irreproachable surface state.

By way of comparison, a similar sample was treated in the same way except that the second predeposition stage was omitted, with both samples being subjected to the same aluminization charge and both being subjected to the same annealing treatment under hydrogen. Surface blistering was observed on the comparison sample at the end of treatment.

EXAMPLE 4

Figure 9:
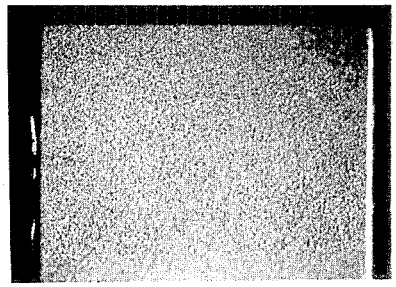

The procedure was the same as in Example 3 except that the high activity aluminide coating was replaced by standard low activity type nickel aluminide coating. A similar result was obtained (FIG. 9). Similarly, a comparison sample treated by omitting the second predeposition stage and subjected to the same charge of cement had surface blistering at the end of treatment.

EXAMPLE 5

The procedure was the same as in Example 4 except that diffusion heat treatment was omitted between depositing the palladium and depositing the nickel. Here again the surface of the sample was free from any blistering and its surface state was irreproachable.

EXAMPLE 6

The procedure was the same as in Example 5, except that the nickel deposit was replaced by a deposit of about 3 μm of cobalt by means of an electrolytic technique under the following conditions:

| Composition of the bath: | |
|---|---|
| hydrated cobalt sulfate: | 175 g/l |
| cobalt chloride: | 80 g/l |
| boric acid: | 20 g/l |
| Current density lying in the range | 2 A/dm$^2$ to 4 A/dm$^2$. |
| Temperature: | 45° C. |

EXAMPLE 7

The procedure was the same as Example 6 except that the chemical deposition of palladium was replaced by electrolytical deposition under the following conditions:

| Composition of the bath: | |
|---|---|
| tetramine palladium chloride: | 50 g/l |
| ammonium hydroxide: | to make pH = 8.5 |
| current density: | 2 A/dm$^2$ |
| temperature: | 50° C. |

EXAMPLE 8

The procedure was the same as in Example 7 with the low activity aluminide coating being replaced by standard high activity type aluminide.

EXAMPLE 9

The procedure was the same as in Example 7, with the cobalt deposit being replaced by a deposit of about 3 μm of chromium applied electrolytically under the following conditions:

| Composition of the bath: | |
|---|---|
| chromium anhydride: | 250 g/l |
| sulfuric acid (d = 1.82) | 2.5 g/l |
| Current density lying in the range | 30 A/dm$^2$ to 50 A/d$^2$. |
| Temperature lying in the range | 45° C. to 55° C. |

EXAMPLE 10

The procedure was the same as in Example 9, except that the low activity aluminide coating was replaced by a standard high activity type aluminide coating.

In all of these examples, samples were obtained that were free from surface blisters and in which the surface state was irreproachable.

Although the method of the invention has been described more particularly in implementations using palladium as the platinum group metal, platinum group metals other than platinum and palladium may also be used in the method. It is also possible to make use of two or more platinum group metals, including platinum, in the same stage or in successive stages of the predeposition treatment.

Naturally the invention is not limited to the methods of predeposition described. In particular, predeposition may be performed chemically, electrolytically, thermochemically, physically, or by sputtering. The aluminization may be performed by diffusion or chemically, electrolytically, thermochemically, or physically.

We claim:

1. A coated metal part comprising a metal substrate and a protective coating, wherein said metal substrate consists essentially of at least one metal selected from the group consisting of Ni, Co, and Fe, and said protective coating is free of blisters and consists essentially of a deposit and a predeposit provided between the substrate and the deposit, wherein said predeposit, which comprises at least one layer, comprises: (1) Pd; and (2) at least one barrier metal selected from the group consisting of Ni, Co, and Cr, wherein said barrier metal is provided on the substrate simultaneously with said Pd and/or said barrier metal forms at least one overlying layer covering the Pd provided on the substrate, and wherein said deposit comprises a Pd-modified aluminide of the metal which constitutes the metal substrate and is at least one member selected from the group consisting of Ni, Co, and Fe, said aluminide being formed by aluminization of the substrate coated with the predeposit in an atmosphere containing hydrogen, and said aluminide being modified by diffusion of Pd from said predeposit into the deposit.

2. A coated metal part according to claim 1, wherein the thickness of the predeposit is not more than about 100 micrometers.

3. A coated metal part according to claim 1, wherein the thickness of the predeposit is about 10 micrometers.

4. A coated metal part according to claim 1, wherein at least one layer in the predeposit consists essentially of an alloy of Pd and at least one barrier metal.

5. A coated metal part according to claim 1, wherein the predeposit comprises only a single layer.

6. A coated metal part according to claim 1, wherein a first layer of the predeposit consists essentially of Pd, and a second layer overlying the first layer consists essentially of at least one barrier metal.

7. A coated metal part according to claim 6, wherein the first and second layers are adjacent to each other.

8. A coated metal part according to claim 6, wherein the predeposit comprises only two layers.

9. A coated metal part according to claim 1, wherein the substrate consists essentially of Ni, the deposit consists essentially of Ni aluminide, and the barrier metal is Ni.

10. A coated metal part according to claim 4, wherein said alloy comprises about 80% Pd by weight and about 20% Ni by weight.

11. A method of protecting the surface of a metal substrate, wherein the metal substrate consists essentially of at least one metal selected from the group consisting of Ni, Co, and Fe, said method comprising the steps of:

(1) preparing a pretreated substrate by forming on the substrate a predeposit by deposition and/or diffusion of a material comprising Pd and at least one barrier metal selected from the group consisting of Ni, Co, and Cr, wherein said predeposit may be provided in a single stage or in successive stages, and the material added to the surface of the substrate during one of said successive stage may be different from the material added during the other successive stages, provided that for each stage in which Pd is added to the surface of the substrate, at least one barrier metal must be added simultaneously with said Pd and/or at least one barrier metal must be added subsequently to the stage in which Pd is added; and (2) forming on the predeposit a deposit by deposition and/or diffusion of aluminum under an atmosphere containing hydrogen, whereby is obtained a blister-free protective coating of Pd-modified aluminide of said metal which constitutes the metal substrate and is selected from the group consisting of Ni, Co, and Fe.

12. A method according to claim 11, wherein the pretreated substrate is brought into contact with a material comprising Al and Cr during the formation of the deposit.

13. A method according to claim 12, wherein the formation of the deposit is by high activity aluminization.

14. A method according to claim 12, wherein the formation of the deposit is by low activity aluminization.

15. A method according to claim 11, wherein at least one stage of the formation of the predeposit comprises a process wherein the added material is deposited at low temperature, followed by diffusion at high temperature and under vacuum.

16. A method according to claim 15, wherein the diffusion is performed at a temperature of about 850° C. under air at a pressure of not more than $10^{-5}$ torr.

17. A method according to claim 11, wherein at least one stage of the formation of the predeposit comprises depositing and/or diffusing an alloy of Pd and at least one barrier metal.

18. A method according to claim 17, wherein the formation of the predeposit comprises only a single stage.

19. A method according to claim 11, wherein the formation of the predeposit comprises a first stage in which Pd is added, and a second stage following said first stage in which at least one barrier metal is added.

20. A method according to claim 19, wherein the second stage follows immediately the first stage.

21. A method according to claim 20, wherein the formation of the predeposit comprises only said first and second stages.

22. A method according to claim 11, wherein the substrate consists essentially of Ni, the aluminide consists essentially of Ni aluminide, and the barrier metal is Ni.

23. A method according to claim 17, wherein said alloy comprises about 80% Pd by weight and about 20% Ni by weight.

24. A method according to claim 23, wherein said alloy is deposited by an electrolytical method.

25. A method according to claim 19, wherein said barrier metal is Ni.

26. A method according to claim 25, wherein Pd is deposited by a self-catalyzing chemical method and Ni is deposited by triode cathode sputtering.

27. A coated metal part produced by the method of claim 11.

28. A coated metal part according to claim 27, which is a hot part in a turbomachine.

29. A coated metal part according to claim 1, which is a hot part in a turbomachine.

* * * * *